United States Patent [19]

Sumner

[11] Patent Number: 4,478,294

[45] Date of Patent: Oct. 23, 1984

[54] POSITIVE FIRE INDICATOR SYSTEM

[75] Inventor: Cyril R. Sumner, Houston, Tex.

[73] Assignee: Halliburton Company, Duncan, Okla.

[21] Appl. No.: 459,291

[22] Filed: Jan. 20, 1983

[51] Int. Cl.[3] ..... E21B 43/116

[52] U.S. Cl. ..... 175/4.56; 166/250; 166/297; 102/200

[58] Field of Search ..... 175/4.56, 4.54, 2, 40, 175/50; 166/63, 250, 297, 299; 102/200, 217, 311, 312, 320, 322, 275.3; 89/1 C

[56] References Cited

U.S. PATENT DOCUMENTS

| | | | |
|---|---|---|---|
| 3,050,149 | 8/1962 | Itria et al. | 102/320 |
| 3,100,444 | 8/1963 | Ball et al. | 175/4.54 |
| 3,367,442 | 2/1968 | Setser | 166/299 |
| 3,860,865 | 1/1975 | Stroud et al. | 89/1 C |
| 3,971,317 | 7/1976 | Gemmell et al. | 102/21 |
| 4,208,966 | 6/1980 | Hart | 102/20 |
| 4,220,212 | 9/1980 | Lands, Jr. | 89/1 C |
| 4,406,226 | 9/1983 | Davitt et al. | 102/311 |

FOREIGN PATENT DOCUMENTS

| | | | |
|---|---|---|---|
| 630639 | 11/1961 | Canada | 102/320 |

*Primary Examiner*—James A. Leppink
*Assistant Examiner*—Hoang C. Dang
*Attorney, Agent, or Firm*—William J. Beard

[57] ABSTRACT

A positive fire indicator well perforating system is disclosed. Predetermined time delay is introduced in a downhole series sequentially fired string of well perforating guns. Surface transducers detect vibratory energy from the downhole guns and record it as a function of time.

21 Claims, 5 Drawing Figures

POSITIVE FIRE INDICATOR SYSTEM

BACKGROUND OF THE INVENTION

This invention relates to perforating systems in general and, more particularly, to high density well perforating systems used in relatively long intervals of a well to be perforated.

It has become fairly common practice in recent years to utilize relatively high density, or a large number of perforating shots per feet, perforating systems in oil well completions. As many as sixteen shots per foot of well interval with a 90° or 120° phasing between perforating shots in the same plane horizontally are typically utilized in such techniques. As many as several hundred feet of potential producing formation may be perforated by high density perforating guns in this manner. Such high density guns may be run by wireline into the cased well bore or in more recent years, such perforating systems may be run in on a production tubing string into the well bore.

In the case of the tubing conveyed perforating systems, a rather lengthy series of sequentially connected perforating guns are run into a cased well bore on the end of a tubing string below a packer. When the sequentially connected string of perforating guns have been run in to the desired depth, the packer is set, and a valve above the packer is used to control the fluid pressure in the tubing string. A reduced pressure (below formation pressure) is usually present in the tubing string and in the wellbore annulus beneath the packer. When this is accomplished the long string of perforating guns connected in series below the packer are sequentially fired (substantially simultaneously) and, since the pressure in the wellbore below the packer is reduced by the control of the fluid in the tubing string, a large pressure differential can exist between the inside of the perforated wellbore casing and the earth formations surrounding the borehole. Rapid out-flow of fluid from the formation into the borehole then backwashes and cleans out the perforations which are accomplished in the conventional manner by shaped charges.

In some tubing conveyed perforating systems. A long series string of perforating guns, up to 1000 feet in length or even longer, may be simultaneously fired. Such guns are typically fired by dropping a sinker bar down the tubing which contains a firing mechanism which detonates a primer cord explosive which in turn detonates the shaped charges in the long string of perforating guns. Detonation is usually accomplished from the top gun of the series string of perforating guns down to the bottom gun and, takes place nearly simultaneously along the entire length of the series connected gun string.

Occasionally, however, a faulty primer cord, or faulty detonation of any single gun in the series of perforating guns run in below the packer on the tubing string, can prevent the guns located beneath it from firing. As each gun is connected sequentially or in series with the guns above it, in such a case a very dangerous situation can exist. High explosives may be present which are still live but unfired in the wellbore without the knowledge of the perforating system operator.

Such live explosives could remain in place for a long time until a well workover is accomplished and the tubing string removed. This could create a potential hazard if unfired high explosives were unknowingly pulled to the surface with the tubing string.

It should be mentioned that in tubing conveyed perforating systems the string of perforating guns may be left in the wellbore on the end of the tubing string after the perforations have been accomplished by firing the guns. Production into the tubing string is accomplished either through or around the perforating gun structure. In other systems, after the string of perforating guns located beneath the packer fired, a mechanism is used to release the fired perforating gun string and drop it to the bottom of the well borehole. In any system it is seen that a dangerous condition could exist if unfired high explosives were still extant in the lower portion of any such tubing conveyed perforating gun and could possibly be detonated when the gun was released and dropped to the bottom of the well borehole, or removed from wellbore.

In short, it is seen that unless some means is provided for detecting whether the entire string of perforating guns beneath the packer has been successfully fired, a dangerous situation could exist in the well borehole which could go undetected and unsuspected.

One of the features of the present invention is to provide a system for detecting whether an entire string of perforating guns which are fired serially, either by wireline, or by a tubing conveyed perforating system, have each been fired by the firing mechanism.

Another aspect of the invention is to provide a method for detection of complete firing of a series sequential string of perforating guns in a well borehole.

BRIEF DESCRIPTION OF THE INVENTION

The techniques of the present invention provide a means for detecting whether a complete string of series sequentially connected perforating guns which are to be fired substantially simultaneously, or nearly so, have all been fired when the firing mechanism for the system is activated. In the system of the present invention this is accomplished through the use of acoustic or pressure wave sensitive transducers located at the surface of the earth above the wellbore which is to be perforated. The acoustic or pressure sensitive transducers are utilized to detect acoustic waves or pressure impulses produced in the well borehole by the firing of the shaped charges in the perforating system. The initial, or uppermost N number of perforating guns, which are series sequentially connected, are fired in the conventional manner by the primer cord serially connecting them. In the system of the present invention however, the last one or two perforating guns in the series sequentially fired string of guns are provided with a delay fuse which delays the firing of these two or fewer guns by a predetermined time interval from the firing of the initial or upper series of guns. Thus, when it is desired to fire the series sequentially connected perforating guns, an initial large explosion occurs when the initial guns of the series are fired. Then there is a time delay initiated by the delay fuse prior to the firing of the last one or two guns in the sequentially connected string. Thus the pressure or acoustic sensitive detectors at the surface will detect two or three distinct pressure impulses or shock waves from the firing of the downhole guns, if and only if, the entire string of perforating guns has successfully fired.

The above and other aspects of the present invention may be better understood by reference to the following drawings which are descriptive of the inventive features of the system but not limitative of such features.

DETAILED DESCRIPTION OF THE INVENTION

Figure 1:
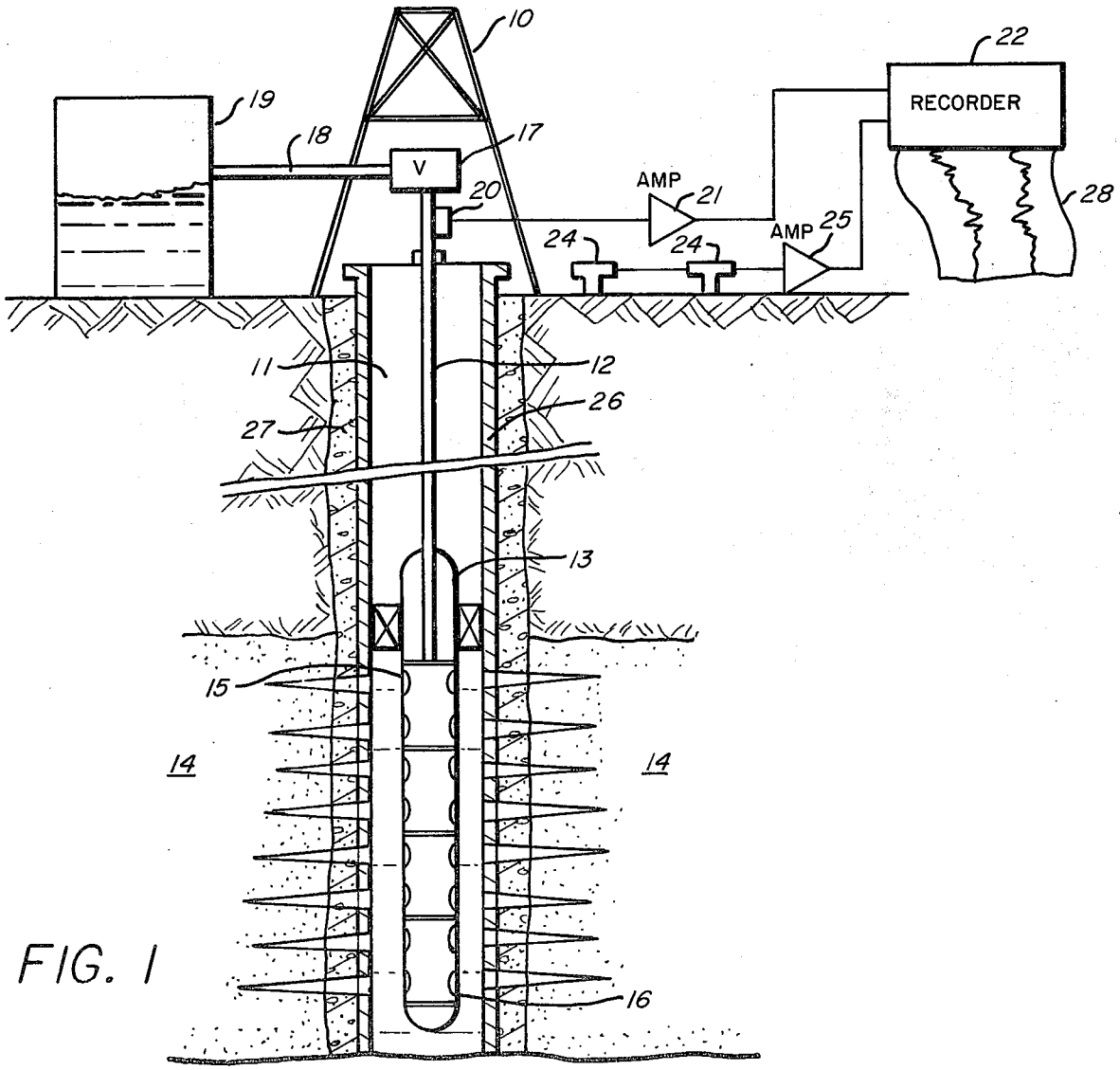
FIG. 1 is a schematic diagram illustrating a tubing conveyed perforating system according to the concepts of the present invention.

Referring initially to FIG. 1, a perforating system according to the concepts of the present invention is illustrated schematically. A well borehole 11 penetrates earth formations 14 and is lined with a steel casing 26 cemented in place by cement sheath 27. A string of production tubing is run from the earth's surface to downhole equipment comprising a packer 13 and valve system (not shown) and a tubing conveyed string of series sequentially fired perforating guns denoted from an upper gun 15 to a lower gun 16. A valve system 17 located at the earth's surface enables well fluid from beneath the packer 13 to be produced via the tubing string 12 and a conduit 18 into a storage tank 19 at the surface of the earth. Draw works 10 illustrated schematically as a well derrick may be utilized to remove or introduce tubing into the well borehole.

At the surface of the earth, pressure or acoustic wave sensitive transducers 20 and 24 are illustrated. At least two different types of such transducers could be used. For example, the transducer 20 could comprise a piezoelectric or magnetostrictive pressure sensitive transducer which is attached to the tubing string 12 at the surface beneath the valve mechanism 17 as illustrated. Thus acoustic waves or pressure pulses produced by a downhole explosion and travelling up the tubing string 12 would be sensed by the transducer 20 and an electrical output signal therefrom amplified in an amplifier 21 and supplied to a recorder 22 which moves a record medium 28 as a function of time.

Alternatively, a geophone type transducer 24 could be stuck in the earth's surface near the location of the well 11 and would sense acoustic or pressure waves travelling through the earth formations 14 to the surface of the earth. Signals from the geophones 24 could be amplified by an amplifying system 25 and similarly supplied to a recorder 22 which moves a record medium 28 as a function of time. In either event it is an object of the techniques of the present invention to detect firing of downhole perforating gun apparatus by sensing either acoustic waves travelling up the tubing string 12 or acoustic or pressure waves travelling through the earth formations 14 in the vicinity of the well borehole and by recording the amplitude of such detected signals as a function of time by the recorder 22.

Figure 2:
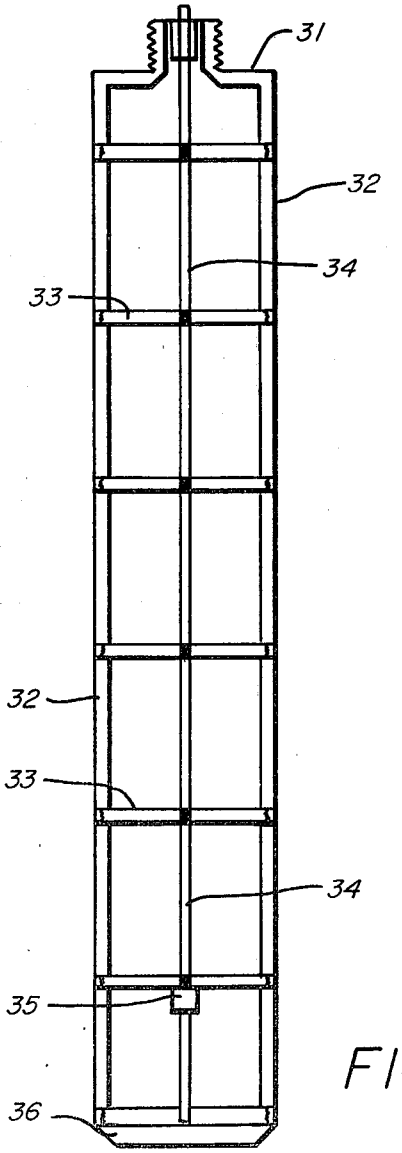
FIG. 2 is a schematic diagram further detailing the downhole gun of the series sequentially connected system according to the concepts of the present invention.

Referring now to FIG. 2 the downhole series sequentially connected string of perforating guns is illustrated in more detail but still schematically. The top sub 31 is connected beneath the packer 13 in a conventional manner as by an adapter sub assembly. The top sub which connects below the packer carries below it a string of series sequentially connected perforating guns 32. Tandem subs 33 join any number as desired of perforating guns 32 together to form a series sequentially connected string of perforating guns.

Figure 4:
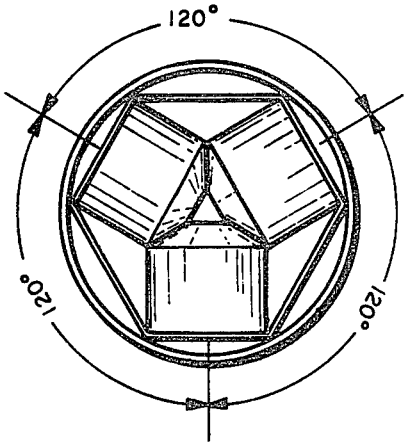
FIG. 4 is a schematic sectional view of a perforating gun showing 120° phasing between shaped charged in a horizontal plane.

While the perforating guns 32 are not shown in detail. It will be understood by those skilled in the art that such guns may typically comprise high density perforating guns containing multiple shaped charges stacked one above the other typically 3 such stacks per gun per foot providing up to 16 perforations per foot of interval at a 90° or 120° phasing in each of three horizontal planes about the circumference of the perforating gun. FIG. 4 illustrates in more detail three shaped charges having 120° phasing in a horizontal plane of the gun. The illustration of FIG. 4 is a schematic cross sectional view taken just above or below one of the horizontal sets of shaped charges carried by the perforating gun. A high explosive primer cord 34 extends from the firing mechanism located above the packer (not shown in FIG. 2) down through the entire series sequentially connected string of perforating guns 32 and tandem subs 33. A bull plug 36 closes the lower end of the series sequential string of perforating guns.

Illustrated at the upper end of the lower most gun 32 and below the lower most tandem sub 33 in the string of sequentially connected guns is an explosive time delay fuse 35 which interrupts the primer cord 34 before its entry into the lowermost perforating gun 32.

When it is desired to fire the string of tubing conveyed perforating guns illustrated in FIGS. 1 and 2 this is typically accomplished by dropping a sinker bar firing mechanism through the production tubing 12 from the surface. When the sinker bar engages a firing mechanism (not shown) located above the packer, the primer cord 34 is detonated by the firing mechanism. This primer detonates extremely high speeds and conducts the detonation to each of the shaped charges carried by the series sequentially connected string of perforating guns, from the top of the assembly toward the bottom. When this occurs, the shaped charges are fired simultaneously, or nearly simultaneously, in the entire top N number of perforating guns connected together in the series sequential fashion. However, when the primer cord 34 is interrupted by the explosive time delay fuse mechanism 35, a predetermined time delay is initiated which must elapse before the lower most gun 32 is fired.

Thus, when the string of series sequentially connected perforating guns are fired by activating the firing mechanism the top N guns are fired virtually simultaneously, producing a large pressure or acoustic impulse which is conveyed to the surface via vibratory motion of the tubing string 12 and earth formation 14 in the vicinity of the borehole. Then the predetermined time delay elapses when the explosive time delay fuse 35 is activated prior to the firing of the lowermost several guns or gun. The lattermost gun 32 is then fired when the delay is complete. Thus a secondary acoustic impulse is produced a predetermined length of time after the firing of the initial or uppermost string of perforating guns in the series. This acoustic or vibratory pressure pulse travels to the surface similarly and both of these pulses are detected by the detectors 20 and 24 of FIG. 1 at the surface.

Figure 3A:
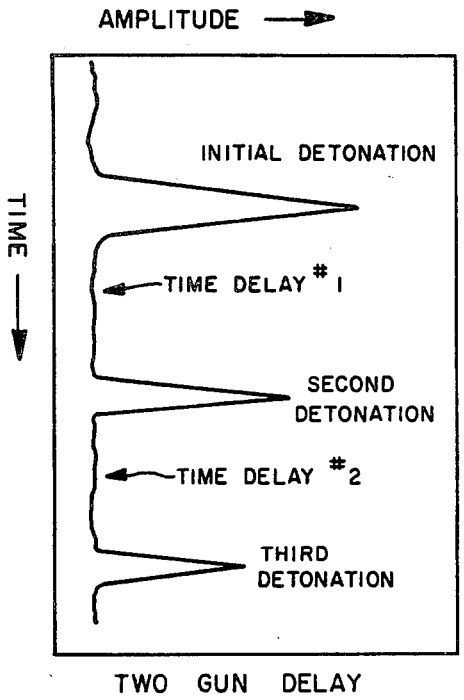
FIGS. 3A and 3B are schematic graphical representation showing two output records produced by the positive fire indicator system of the present invention.
Figure 3B:
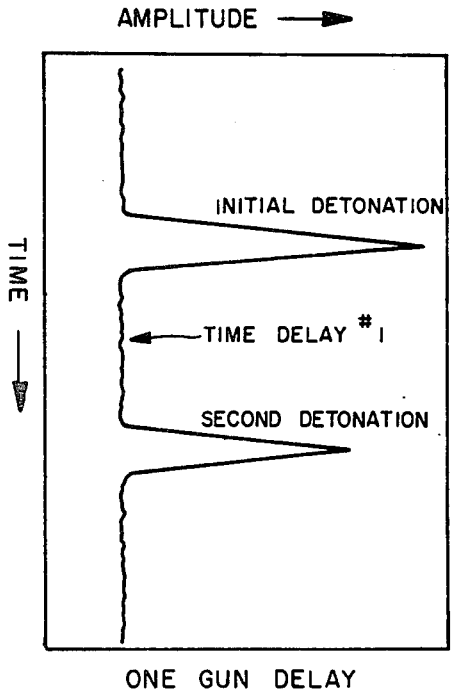

The amplified detector signals are supplied to the recorder 22 and placed upon a record medium 28 as a function of time. A schematic illustration of the time record produced on the second medium is shown in FIG. 3*b*. Alternatively it may be desired to introduce two different time delay mechanism in the string of series sequentially fired guns at different points in the string. A time record illustrating the output of this technique is shown in FIG. 3A. In either event a time record is produced which is characteristic of a particular firing sequence being fully executed by the system.

Thus it is possible using the techniques of the present invention to see time separated impulses reach the surface, if and only if, the entire string of series sequentially connecting perforating guns has been properly fired. This prevents the possibility of the lower guns in the series sequentially connected string from failure to fire going undetected. Thus, the detecting system of the present invention maybe referred to as a positive firing indicator system.

While the techniques of the present invention have been illustrated with respect to a tubing conveyed perforating gun system, it will be understood by those skilled in the art that the same techniques are equally applicable to series sequentially connected guns which are lowered into a well borehole on electrical wireline and fired electrically by the wireline mechanism. Similarly, it will be appreciated that other firing mechanisms for firing the series sequentially connected perforating guns could be used. For example, a system which would sequentially fire the guns from the bottom of the string toward the top. In such a case the explosive time delay fuse 35 would be inserted near the last gun or guns near the top of the string of series sequentially connected guns to indicate that the primer cord 34 has indeed initiated firing of all charges should that be the mechanism utilized.

The foregoing descriptions may make other alternative arrangements according to the concepts of the present invention apparent to those skilled in the art. It is the aim of appended claims to cover all such changes and modifications which fall within the true and scope of the invention.

I claim:

1. A method for positively detecting the firing of all of a string of series sequentially connected well perforating guns in a well borehole, comprising the steps of:

connecting a string of well perforating guns together with a primer cord in series sequential firing order and placing said string of guns in a well borehole located opposite a formation interval to be perforated;

interrupting said primer cord between the ultimate gun in said string and the penultimate gun in said string with a time delay fuse having a predetermined value of time delay;

firing said string of series sequentially connected perforating guns in series relationship by detonating said primer cord from an end thereof opposite from said ultimate gun thereby detonating said perforating guns sequentially along said string from said opposite end gun through said penultimate gun and then detonating said delay fuse and said ultimate gun after a time delay introduced by said time delay fuse;

detecting at the surface of the earth vibratory energy propagated thereto by the detonation of said string of perforating guns and recording representations of said vibratory energy on a record medium as a function of time.

2. The method of claim 1 wherein said detecting step is performed by detecting said vibratory energy propagated to the surface of the earth along a string of well production tubing extending from the surface into the well borehole.

3. The method of claim 2 wherein said detecting step is performed with a piezoelectric transducer.

4. The method of claim 2 wherein said detecting step is performed with a magnetostrictive transducer.

5. The method of claim 1 wherein said detecting step is performed by detecting vibratory energy propagated to the surface of the earth by the earth formations, said energy being detected by geophones placed in intimate contact with the earth on the surface thereof.

6. The method of claim 1 wherein a plurality of time delay fuses are used to interrupt said primer cord at plural points in said string of series sequentially connected perforating guns.

7. A system for positively detecting the firing of all of a string of series sequentially connected well perforating guns disposed in a well borehole, comprising:

a plurality of series sequentially connected well perforating guns having a first end and an ultimate end, said guns being series sequentially connected via a common primer cord;

a time delay fuse inserted in said primer cord between the ultimate and the penultimate guns in said string of perforating guns and being of a predetermined delay time;

means for detonating said primer cord from said first end thereof and thereby detonating said delay fuse and said ultimate perforating gun after said predetermined time delay; and means for detecting at the surface of the earth vibratory energy propagated thereto by the detonation of said string of perforating guns and means for recording representations of said vibratory energy on a record medium as a function of time.

8. The system of claim 7 wherein said means for detecting at the surface of the earth vibratory energy comprises means for detecting such vibratory energy propagated to the surface of the earth along a production tubing string extending from the surface of the earth into the well borehole.

9. The system of claim 8 wherein said detecting means comprises a piezoelectric transducer.

10. The system of claim 8 wherein said detecting means comprises a magnetostrictive transducer.

11. The system of claim 7 wherein said means for detecting at the surface of the earth vibratory energy comprises geophone means placed in intimate contact with the earth's surface.

12. The system of claim 7 and further including at least one additional time delay fuse placed so as to interrupt said primer cord in at least one additional place along its series connection to said well perforating guns.

13. A method for positively detecting the firing of all of a string of series sequentially connected well perforating gun in a well borehole, comprising the steps of:

connecting a string of well perforating guns together with a primer cord in series sequential firing order and placing said string of guns in a well borehole located opposite a formation interval to be perforated;

interrupting said primer cord between a pair of guns in said string with a time delay fuse having a predetermined value of time delay;

firing said string of series sequentially connected perforating guns in series relationship by detonating said primer cord from one end thereof thereby detonating said perforating guns sequentially along said string from said one end gun through one of said pair of guns separated by said delay fuse and then detonating said delay fuse and the remainder of said string of guns after a time delay introduced by said time delay fuse;

detecting at the surface of the earth vibratory energy propagated thereto by the detonation of said string of perforating guns and providing an indication as a function of time of said vibratory energy.

14. The method of claim 13 wherein said detecting step is performed by detecting said vibratory energy propagated to the surface of the earth along a string of well production tubing extending from the surface into the well borehole.

15. The method of claim 14 wherein said detecting step is performed with a piezoelectric transducer.

16. The method of claim 14 wherein said detecting step is performed with a magnetostrictive transducer.

17. The method of claim 13 wherein said detecting step is performed by detecting vibratory energy propagated to the surface of the earth by the earth formations, said energy being detected by geophones placed in intimate contact with the earth on the surface thereof.

18. The method of claim 13 wherein a plurality of time delay fuses are used to interrupt said primer cord at plural points in said string of series sequentially connected perforating guns.

19. The method of claim 13 and further including the step of recording representations of said vibratory energy on a record medium.

20. The method of claim 19 wherein said recording step is performed as a function of time.

21. The method of claim 13 wherein said pair of guns separated by said delay fire comprise the ultimate gun in said string on the end of said string of guns opposite thereof from said one end thereof from which said primer cord is detonated and the penultimate gun from the same end thereof.

* * * * *